US007228097B2

(12) United States Patent
Matsumoto

(10) Patent No.: US 7,228,097 B2
(45) Date of Patent: Jun. 5, 2007

(54) IMAGE FORMING APPARATUS

(75) Inventor: Hirotaka Matsumoto, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/946,391

(22) Filed: Sep. 22, 2004

(65) Prior Publication Data

US 2005/0042003 A1 Feb. 24, 2005

Related U.S. Application Data

(63) Continuation of application No. 10/430,393, filed on May 7, 2003, now Pat. No. 6,804,488.

(30) Foreign Application Priority Data

May 9, 2002 (JP) ..... 2002-134067

(51) Int. Cl.
*G03G 15/20* (2006.01)

(52) U.S. Cl. ..... 399/327

(58) Field of Classification Search ..... 399/326, 399/327

See application file for complete search history.

(56) References Cited

U.S. PATENT DOCUMENTS

| | | | | |
|---|---|---|---|---|
| 5,045,890 | A * | 9/1991 | DeBolt et al. | 399/325 |
| 5,049,944 | A * | 9/1991 | DeBolt et al. | 399/325 |
| 6,347,197 | B1 | 2/2002 | Maul et al. | |
| 6,427,060 | B1 | 7/2002 | Arakawa et al. | |
| 6,778,803 | B2 | 8/2004 | Matsumoto | |
| 2003/0210937 | A1 | 11/2003 | Matsumoto | |

FOREIGN PATENT DOCUMENTS

| | | |
|---|---|---|
| EP | 1 265 114 A2 | 12/2002 |
| JP | 5-158374 A | 6/1993 |
| JP | 10-307499 A | 11/1998 |

* cited by examiner

*Primary Examiner*—Quana Grainger
(74) *Attorney, Agent, or Firm*—Foley & Lardner LLP

(57) ABSTRACT

A fixing device according to this invention includes a notifying mechanism which requests replacement of a web when the length up to the end portion of the web capable of taking unnecessary toner becomes shorter than a predetermined length. The degree of moving an unused portion of the web to a web-taking unit is reduced at a predetermined ratio until the web is replaced.

9 Claims, 6 Drawing Sheets

| Count value (number of fed sheets) | Web feed amount | Display |
|---|---|---|
| 500,000 or less | Normal control (feed by 0.3mm in one operation every 10 sheets) | None |
| Over 500,000 up to web end | Deceleration control (feed by 0.3mm in one operation every 20 sheets) | Display that web replacement time comes close |
| Web end | Stop | Display that web must be replaced |

IMAGE FORMING APPARATUS

CROSS-REFERENCE TO RELATED APPLICATIONS

The present application is a continuation of U.S. application Ser. No. 10/430,393, filed May 7, 2003 now U.S. Pat. No. 6,804,488, the entire contents of which are incorporated herein by reference.

This application is based upon and claims the benefit of priority from the prior Japanese Patent Application No. 2002-134067 filed May 9, 2002, the entire contents of which are incorporated herein by reference.

BACKGROUND OF THE INVENTION

1. Field of the Invention

The present invention relates to a fixing device which is employed in, e.g., a copying machine or printer apparatus using toner, and fixes a toner image onto a medium to be transferred.

2. Description of the Related Art

A fixing device which is assembled into a copying machine using an electrophotographic process heats and melts toner on a medium to be transferred, and fixes the toner onto the medium.

As a toner heating method usable in the fixing device, a method using radiation heat obtained by turning on a filament lamp, and a flash-fixing method using a flash lamp have widely been known. Recently, a fixing device using an induction heating device as a heat generation source is put into practical use.

In many cases, the fixing device uses a heat (fixing) roller which incorporates a heater, and a press roller which is pressed against the heat roller at one point on the outer surface of the heat roller at a predetermined pressure. With this structure, heat can be efficiently supplied from the heat generation source to toner. A pressure for fixing melted toner onto a medium to be transferred can be easily applied to the medium and toner.

Most of toners used in a copying machine and printer apparatus are granular particles or powder particles prepared by coating a pigment or dye with a hot-melt resin. Toner which is not fixed to a medium to be transferred often remains at a portion of the fixing device which contacts melted toner. Thus, many fixing devices having a cleaning device which recovers toner left on the heat roller are commercially available.

As a method of cleaning the heat roller, felt is brought into contact with the outer surface of the heat roller, and oil which prevents toner from attaching to the heat roller is supplied. Toner is fixed to a portion where it is brought into contact with the heat roller in the use of felt. Thus, the felt is formed into a roller shape to prevent toner from being fixed to one portion.

Even with the felt roller, the toner recoverable amount decreases and the image quality degrades during the maintenance cycle because of an increase in the image forming speed of a copying machine and printer apparatus and prolongation of the maintenance cycle of the copying machine and printer apparatus. If felt containing a large amount of toner is pressed against the heat roller for a long time, the heat roller surface is scratched.

To solve these problems, a web cleaning method of changing (shifting) the position of felt brought into contact with the heat roller in accordance with the cumulative image forming count (lapse of a predetermined time).

In the use of the felt web, the web containing toner is sequentially taken up. The replacement time of the cleaning device can be set by setting the web amount in accordance with the maintenance cycle. The web may be coated with oil which prevents toner from attaching to the heat roller.

Even if the felt web is adopted, the web amount assembled into the fixing device has an end portion (roll length) due to the maintenance cycle, the internal space of the apparatus, and the like.

If the web of the cleaning device runs out but image forming operation continues, the heat roller is quickly contaminated. In the worst case, the heat roller surface is scratched and cannot be used (must be replaced). Replacement of the heat roller requires a long time and high cost.

If the copying machine or printer apparatus is stopped when the web runs out, the serviceman mounts a new web, and the copying machine or printer apparatus can be used again without scratching the heat roller surface. However, the copying machine or printer apparatus cannot be used until the serviceman mounts a new web.

BRIEF SUMMARY OF THE INVENTION

It is an object of the present invention to provide an image forming apparatus capable of operating a cleaning mechanism while preventing the stop of an image forming apparatus using a fixing device with the cleaning mechanism.

According to a first aspect of the present invention, there is provided a fixing device comprising: a heat-producing member which is formed into a hollow cylinder or an endless belt, has a outer surface of the cylinder or a belt surface of the belt movable at a predetermined speed, and can supply predetermined heat to a hot-melt substance and a medium holding the hot-melt substance; a pressure application mechanism which has a outer surface that can move following the outer surface of the cylinder or the belt surface of the belt when the outer surface of the cylinder or the belt surface of the belt of the heat-producing member is moved at the predetermined speed, and which applies a predetermined pressure to the heat-producing member while interposing the hot-melt substance and the medium between the heat-producing member and the pressure application mechanism; a heat-producing member exciter mechanism which is set to increase a temperature of the heat-producing member, and allows the object to generate heat; a hot-melt substance-taking member which is brought into contact with the outer surface of the cylinder or the belt surface of the belt of the heat-producing member at a predetermined pressure, and can take the hot-melt substance attached to the outer surface of the cylinder or the belt surface of the belt; a hot-melt substance-taking member changer which can move the hot-melt substance-taking member by a predetermined amount in a region where the hot-melt substance-taking member is brought into contact with the outer surface of the cylinder or the belt surface of the belt of the heat-producing member at the predetermined pressure when a predetermined amount of the hot-melt substance is absorbed in the hot-melt substance-taking member; a hot-melt substance-taking member changer control device which moves the hot-melt substance-taking member at a predetermined timing in the region where the hot-melt substance-taking member is brought into contact with the outer surface of the cylinder or the belt surface of the belt of the heat-producing member; and an end portion detection mechanism which can detect an end portion and a vicinity of the hot-melt substance-taking member, wherein, when the end portion detection mechanism detects that a remaining portion of the hot-melt substance-taking member reaches a predetermined amount up to the end portion of the hot-melt substance-taking member, an operation timing of the hot-melt substance-taking member changer by the hot-melt substance-taking member changer control device is delayed at a predetermined ratio.

According to a second aspect of the present invention, there is provided an image forming apparatus comprising: a display which can display an operation state of the apparatus and a predetermined message; a photosensitive member which can hold an electrostatic image; a developing device which supplies toner to the electrostatic image formed on the photosensitive member and visualizes the electrostatic image; a transfer device which transfers, to a medium to be transferred, a toner image formed by supplying the toner from the developing device to the electrostatic image formed on the photosensitive member; and a fixing device which includes a heating member capable of supplying predetermined heat to the toner serving as the toner image on the medium to be transferred, a temperature increasing mechanism that increases temperatures of the heating member and a press member capable of applying a predetermined pressure to the heat member in order to fix the toner melted by heat from the heating member to the medium to be transferred, and a web cleaning mechanism that removes toner attached to a surface of the heating member, the fixing device applies heat and a pressure to the toner image transferred to the medium to be transferred, thereby fixing the toner image to the medium to be transferred, wherein the web cleaning mechanism includes a web which is brought into contact with the surface of the heating member, a web-taking mechanism which moves a web to which a predetermined amount of toner is attached upon contact with the surface of the heating member for a predetermined time, a remaining web amount detection mechanism which detects a remaining web amount, and a web-taking mechanism driver which operates the web-taking mechanism at a predetermined timing, and when the remaining web amount detection mechanism detects that the remaining web amount becomes not more than a predetermined amount, the display is instructed to display the predetermined message, and when the remaining web amount detection mechanism detects that the remaining web amount becomes not more than the predetermined amount, a timing at which the web-taking mechanism is operated by the web-taking mechanism driver can be reduced at a predetermined ratio.

According to a third aspect of the present invention, there is provided an image forming apparatus including a web cleaning mechanism as a heat roller cleaning mechanism, comprising: a detection mechanism which can detect absence of a web; a remaining amount detection mechanism which can detect a remaining amount of the web; a web feed amount control mechanism which changes a feed amount of the web in accordance with a condition; and a notifying mechanism which can output a warning that requests replacement of the web.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

A digital copying machine will be described below with reference to the several views of the accompanying drawing as an example of an image forming apparatus to which a preferred embodiment of the present invention is applied.

Figure 1:
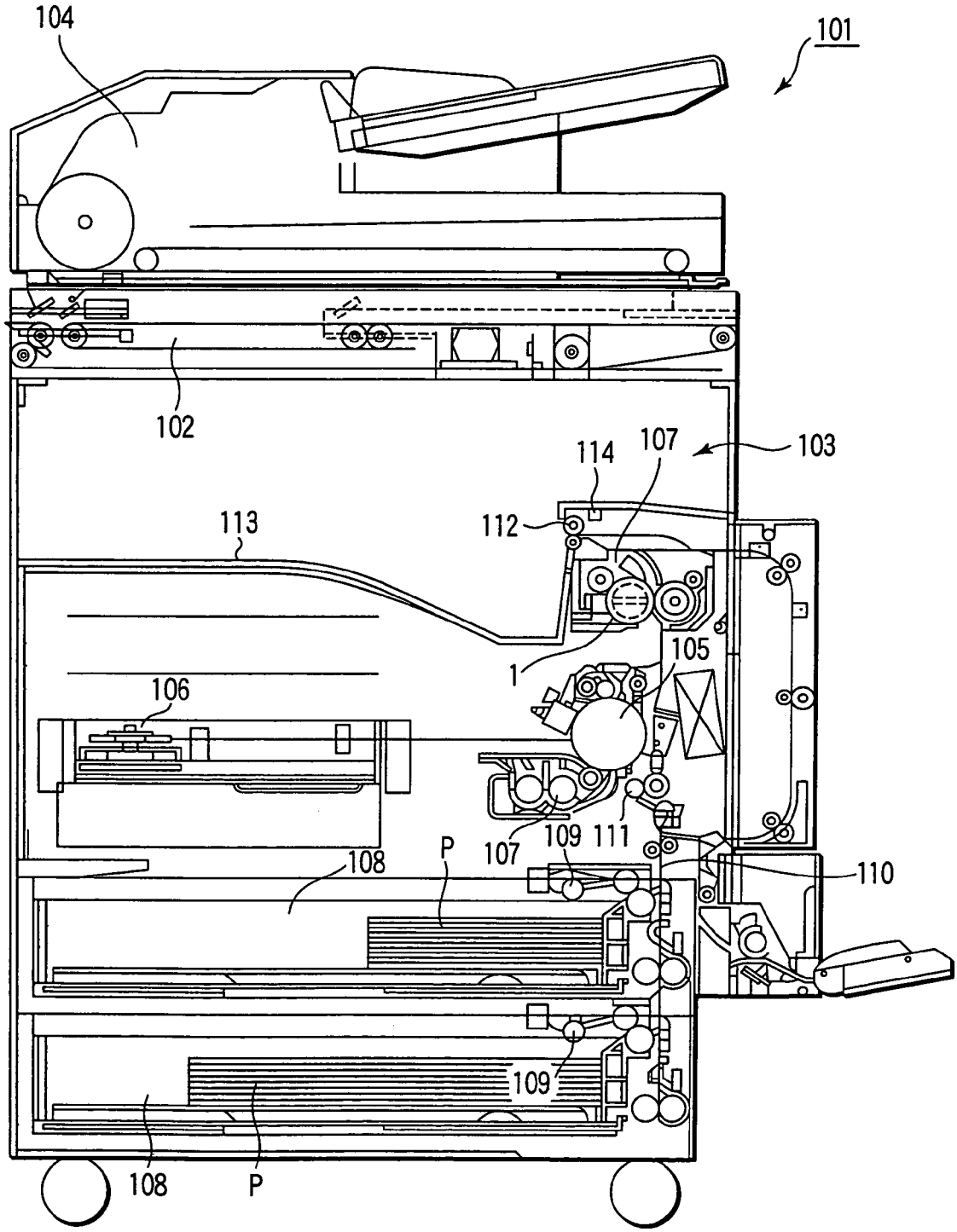
FIG. 1 is a schematic view for explaining an example of an image forming apparatus which incorporates a fixing device according to the present invention.

As shown in FIG. 1, a digital copying machine (image forming apparatus) 101 includes an image reading device (scanner) 102 and image forming section 103. The scanner 102 catches an image to be copied as the brightness and darkness of light, photoelectrically converts the image, and generates image data. The image forming section 103 forms an image corresponding to image data supplied from the scanner 102 or externally, and fixes the image onto a sheet P serving as a medium to be transferred. The scanner 102 is integrated with an automatic document feeder (ADF) 104 functioning as a cover for pressing an object to be copied against the reading surface, i.e., document table (not to be described in detail) of the scanner 102. As is known well, when the object to be copied is a sheet, the ADF 104 eliminates a step of opening/closing the ADF 104 from/to the document table for each sheet and pressing an object to be copied against the document table. The ADF 104 allows sequentially replacing objects to be copied in association with reading operation of images to be copied by the scanner 102.

The image forming section 103 has a cylindrical photosensitive drum 105 whose outer surface is covered with a photosensitive member. When light irradiates the photosensitive drum while a predetermined potential is applied, the potential of a region irradiated with light changes. The photosensitive member can hold a change of the potential as an electrostatic image for a predetermined time.

The photosensitive drum 105 is exposed to image information to be output by an exposure device 106 capable of outputting a laser beam which is changed in light intensity in correspondence with image data supplied from the scanner 102 or an external device. An image is then formed as the change of the potential corresponding to the electrostatic image, i.e., image data on the outer surface of the photosensitive drum 105.

The image formed on the photosensitive drum 105 is visualized by selectively supplying toner from a developing device 107.

By applying a transfer voltage from a transfer device (not to be described in detail), a toner member, i.e., toner image which is developed on the photosensitive drum 105 by supplying toner from the developing device 107 is transferred onto a sheet P fed to a transfer position in the following step. In order to transfer a toner image at the transfer position, sheets P are picked up one by one from a cassette 108 by a pickup roller 109. Each sheet P is conveyed up to an aligning roller 111 in advance via a convey path 110 defined between the photosensitive drum 105 and the cassette 108. The aligning roller 111 is rotated at a predetermined timing in order to align the sheet P with the toner image formed on the photosensitive drum 105. The sheet P conveyed up to the aligning roller 111 is aligned with the toner image on the photosensitive drum 105 and supplied to the transfer position.

By moving the sheet P, the toner image transferred onto the sheet P by the transfer device is conveyed to a fixing device 1.

The toner image transferred onto the sheet P is melted by heat and a pressure from the fixing device 1, and fixed onto the sheet P by a pressure applied by the fixing device 1.

The sheet P with the toner image fixed by the fixing device 1 is output and stacked to an output tray 113 by an output roller 112 serving as a space defined between the sheet cassette 108 and the scanner 102. The number of printouts (sheets) discharged on the discharge tray 113 is counted by a discharge counter 114.

Figure 2:
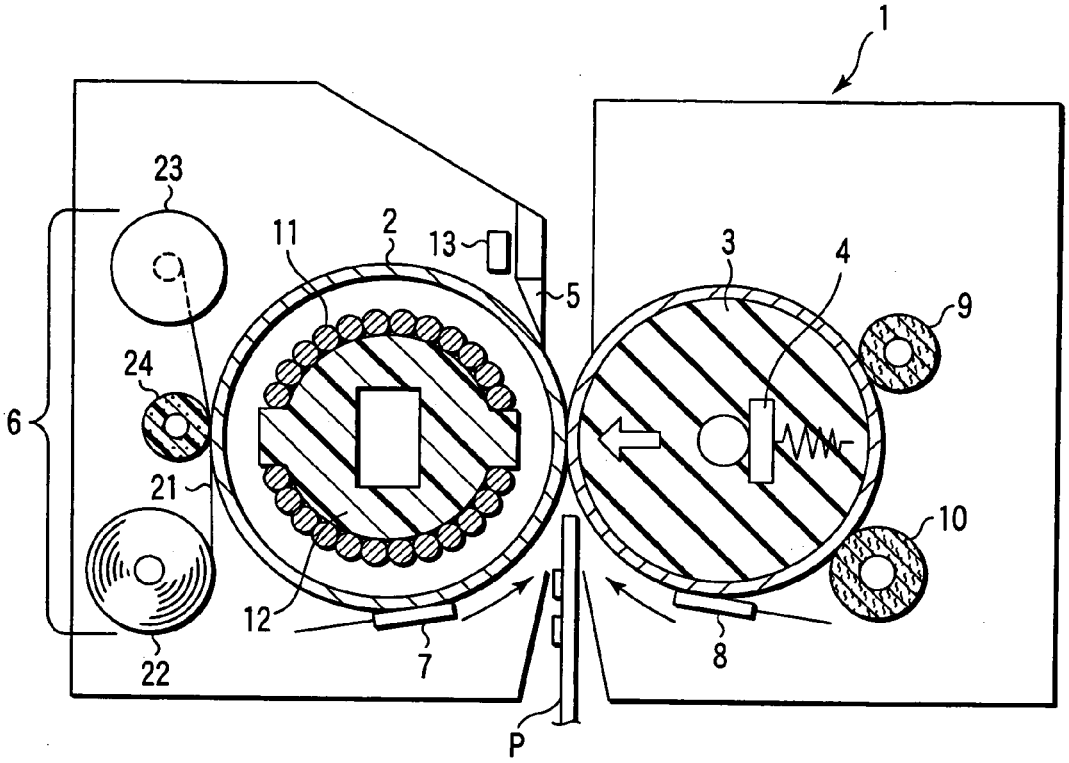
FIG. 2 is a schematic view for explaining an example of the fixing device which can be used in the image forming apparatus shown in FIG. 1.
Figure 3:
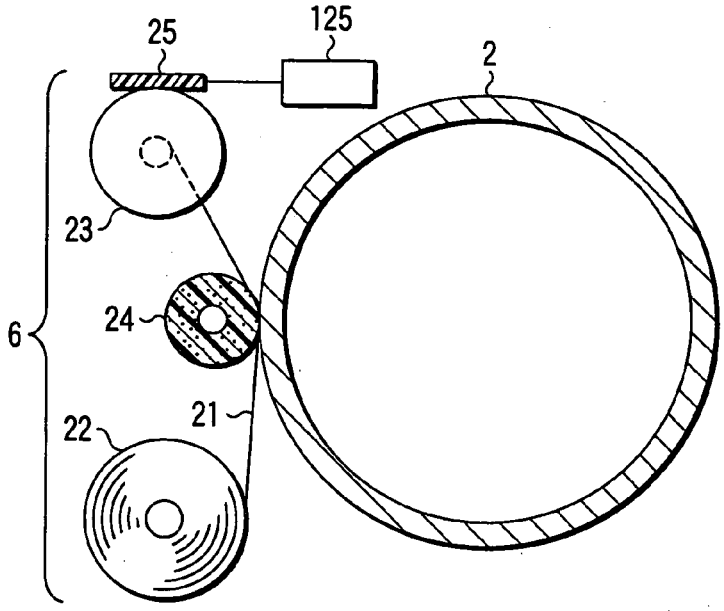
FIG. 3 is a schematic view for explaining an example of a web cleaning mechanism used in the fixing device shown in FIG. 2.

FIGS. 2 and 3 are schematic views for explaining an example of the fixing device used in the image forming apparatus shown in FIG. 1. FIG. 3 shows in detail a web type cleaner which is integrated into the fixing device 1 shown in FIG. 2. A fixing device using an induction heating type heating mechanism will be exemplified in FIGS. 2 and 3, but the heating mechanism can be of any type.

The fixing device 1 includes a heating (fixing) roller 2 with a diameter of about 60 mm and a press roller 3 with a diameter of about 60 mm.

The heat roller 2 is made of a metal with a thickness of about 2 mm, and is a hollow cylinder in this example. A release layer (not shown) obtained by depositing a fluoroplastic such as tetrafluoroethylene resin to a predetermined thickness is formed on the surface of the heat roller 2. The roller material of the heat roller 2 can be stainless steel, iron, nickel, aluminum, an alloy of stainless steel and aluminum, or the like. The length of the heat roller 2 is about 340 mm in this embodiment. Note that the heat roller 2 may be replaced by a metal film formed from an endless belt of a sheet member prepared by depositing a metal to a predetermined thickness on the surface of a heat-resistant resin film.

The press roller 3 is an elastic roller prepared by coating a rotating shaft having a predetermined diameter with silicone rubber, fluororubber, or the like having a predetermined thickness. The length of the press roller 3 is about 320 mm.

The press roller 3 is almost parallel to the axis of the heat roller 2, and pressed by a press mechanism 4 with respect to the axis of the heat roller 2 at a predetermined pressure. Part of the outer surface of the press roller 3 elastically deforms, defining a predetermined nip between the two rollers. When the metal film is used instead of the heat roller 2, the nip may be formed on the film side.

The heat roller 2 is rotated in a direction indicated by an arrow at an almost constant speed by a fixing motor 123 (see FIG. 4) or a drum motor 121 (see FIG. 4) which rotates the photosensitive drum 105.

When the heat roller 2 is rotated, the press roller 3 is rotated at a predetermined speed together with the heat roller 2. This is because the press roller 3 is in contact with the heat roller 2 by the press mechanism 4 at a predetermined pressure.

A separation claw 5 which peel a sheet P having passed through the nip from the heat roller 2 is located at a predetermined position on the outer surface of the heat roller 2 near the nip on the downstream side of the nip (contact point) between the heat roller 2 and the press roller 3 in a direction in which the roller 2 is rotated.

A web cleaning mechanism 6 and thermistor 7 are sequentially arranged around the heat roller 2 so as to be spaced apart from the separation claw 5 along the direction in which the roller 2 is rotated.

The web cleaning mechanism 6 is used to remove (clean) toner offset on the heat roller 2 and dust particles of paper from a sheet serving as a medium to be transferred. The web cleaning mechanism 6 is also used to coat a release agent (e.g., silicone oil) for preventing toner from being fixed onto the release layer of the heat roller 2.

The thermistor 7 is used to detect the surface temperature of the roller 2. The thermistor 7 can be arranged at an arbitrary position on the circumference of the roller 2 (phase when viewed from the direction of section need not be set). Two or more thermistors may be arranged.

A thermistor 8, oil roller 9, and cleaning roller 10 are arranged on the outer surface of the press roller 3. The thermistor 8 detects the temperature of the outer surface of the press roller 3. The oil roller 9 applies a release agent such as silicone oil to the outer surface of the press roller 3. The cleaning roller 10 removes, e.g., toner attached to the outer surface of the press roller 3.

The heat roller 2 incorporates an exciting coil 11 which causes the material of the roller 2 to generate an eddy current. The exciting coil 11 is formed into a length enough to heat a sheet by a width by which the sheet is in contact with the outer surface of the roller 2 when, e.g., an A4-size sheet is conveyed with its short side parallel to the axis of the heat roller 2.

The exciting coil 11 is formed from a litz wire as a bundle of a plurality of, in this example 16 wires prepared by insulating copper wires with a diameter of, e.g., 0.5 mm from each other by heat-resistant polyamide-imide. Since the exciting coil 11 is formed from the litz wire, the diameter of each wire can be set smaller than the permeation depth of the skin effect which occurs when a high-frequency AC current flows through the wire. As a result, a high-frequency current can be effectively supplied.

The exciting coil 11 is an air-core coil wound around a coil holding member 12 made of engineering plastic or ceramic which exhibits high heat resistance and high insulating property. The coil holding member 12 can be made of PEEK (poly ether ether ketone), phenol, unsaturated polyester, or the like. The wire which forms the exciting coil 11 can be arbitrarily wound. In the example shown in FIG. 2, the coil holding member 12 is shaped, and a flat coil is wound along the inner surface of the heat roller 2.

An example of the web cleaning mechanism will be explained with reference to FIG. 3.

The web cleaning mechanism 6 has a web supply, member 22 and web-taking member 23. The web supply member 22 is wound by a predetermined length with a webs 21 prepared by forming into, e.g., a felt sheet a chemical fiber which can resist the high temperature of the heat roller 2, e.g., 220° C. The web-taking member 23 takes up the web 21 by a predetermined amount.

The web 21 contains in advance a predetermined amount of silicone oil serving as a release agent. The thickness of the web 21 is, e.g., 54 μm.

A press roller 24 is interposed between the web supply member 22 and the web-taking member 23. The press roller 24 brings the web 21 which is suspended from the web supply member 22 to the web-taking member 23, into contact with the outer surface of the heat roller 2 at a predetermined pressure.

An arbitrary region on the outer surface of the heat roller 2 always contacts the web 21 by rotating the heat roller 2. A predetermined amount of silicone oil is supplied to the outer surface of the heat roller 2, forming an oil thin layer.

The press roller 24 is formed from a sponge with a hardness of, e.g., 30° and an outer diameter of 20 mm. The press roller 24 is slightly rotated upon movement of the web 21 when the web 21 is recovered by the web-taking member 23 by a driving mechanism to be described later. This prevents elastic deformation of the roller 24 at a pressure when the web 21 is pressed against the press roller 3.

Figure 4:
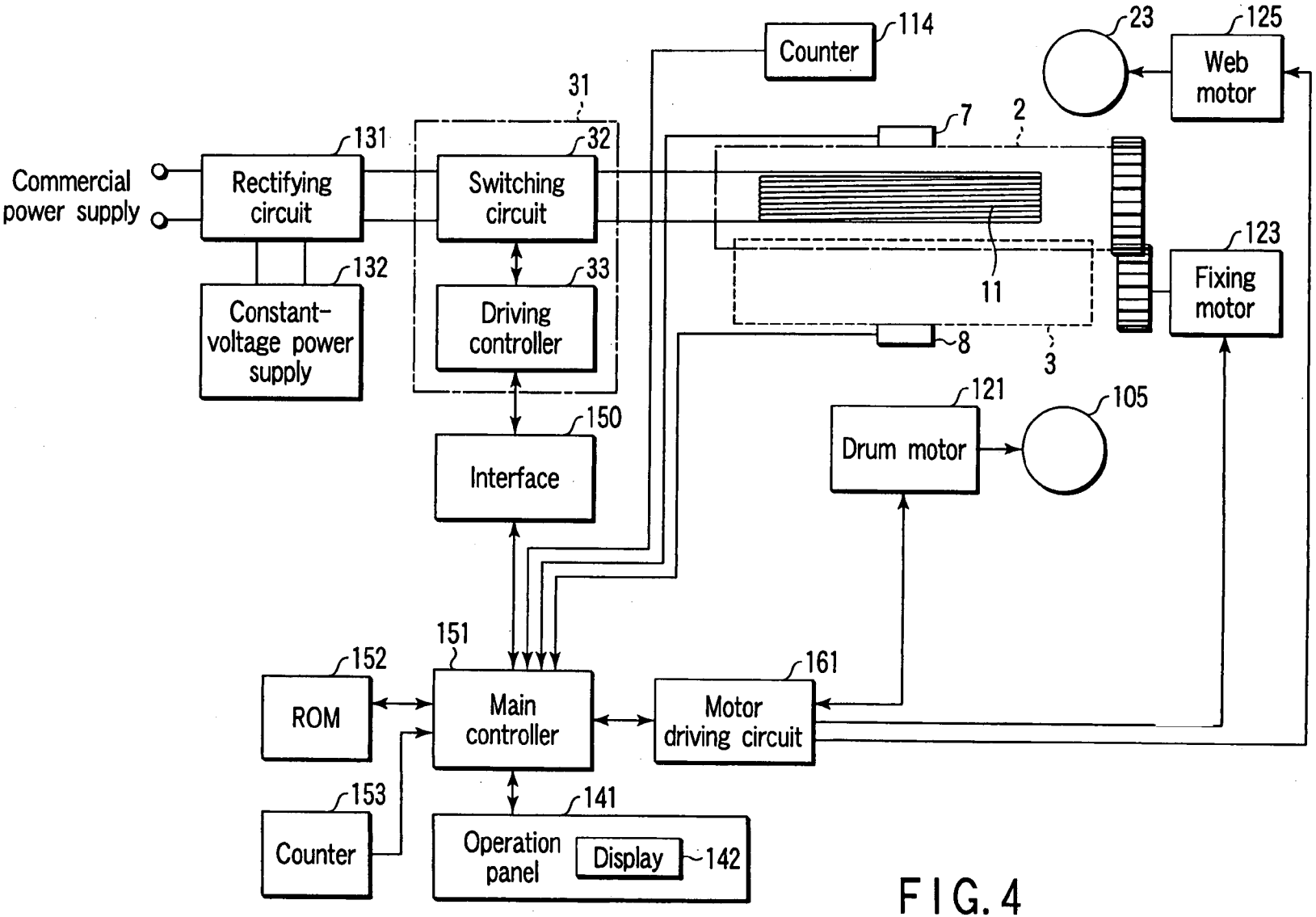
FIG. 4 is a schematic block diagram for explaining a control system for the fixing device shown in FIGS. 2 and 3 and the image forming apparatus shown in FIG. 1.

The web-taking member 23 is rotated by a predetermined amount at a predetermined timing by a rotation transfer mechanism 25 such as a gear train or a set of a belt and wheel which is rotated by a web motor 125 (see FIG. 4). An amount (to be referred to as a web feed amount hereinafter) by which the web 21 is moved by one operation is 0.3 mm for an image forming count of 10 (10 printouts) in the fixing device shown in FIG. 2, i.e., the digital copying machine 101 shown in FIG. 1.

FIG. 4 is a schematic view for explaining an example of a control circuit for operating the fixing device and web cleaning mechanism shown in FIGS. 2 and 3.

As described above, the heat roller 2 of the fixing device 1 incorporates the exciting coil 11 for causing the metal material of the heat roller 2 to generate an eddy current, thus generating heat. The exciting coil 11 is connected to an exciting unit 31 which supplies a high-frequency output having a predetermined frequency to the exciting coil 11.

The exciting unit 31 includes a switching circuit 32 and driving controller 33. The switching circuit 32 can output a high-frequency output with a predetermined frequency which is to be supplied across the exciting coil 11. The driving controller 33 supplies a control signal for causing the switching circuit 32 to output a high-frequency output with a predetermined frequency.

The switching circuit 32 receives a DC voltage from a rectifying circuit 131 which rectifies an AC voltage received from a commercial power supply and supplies a DC voltage. The operation power supply of the driving controller 33 utilizes a voltage obtained by adjusting a rectified output from the rectifying circuit 131 into a constant voltage by a constant-voltage circuit 132 in order to suppress the influence of a change in voltage which returns via the switching circuit 32 upon a change in output from the exciting coil 11.

The driving controller 33 is connected to a main controller 151 of the image forming section 103 via an interface 150. The driving controller 33 determines a frequency to be output from the switching circuit 32 in accordance with an output from the thermistor 7 which is a detection output as a result of detecting the temperature of the outer surface of the heat roller 2, an output from the thermistor 8 which is a detection output as a result of detecting the temperature of the outer surface of the press roller 3, and a control signal input from the main controller 151 of the image forming section 103. The driving controller 33 then sets the frequency of a high-frequency output from the switching circuit 32.

The main controller 151 of the image forming section 103 is connected to a motor driving circuit 161 which rotates a motor to be described later at a predetermined rotational speed.

The copying machine 101 shown in FIG. 1 incorporates the drum motor 121, fixing motor 123, and web motor 125. The drum motor 121 rotates the photosensitive drum 105 at a predetermined rotational speed. The fixing motor 123 rotates the heat roller 2 of the fixing device 1, and the web motor 125 rotates the web-taking member 23 of the web cleaning mechanism 6.

More specifically, when the main controller 151 designates rotation of an arbitrary motor, the motor driving circuit 161 supplies a predetermined number of motor driving pulses to a corresponding motor. The fixing motor 123 may be omitted, and rotation of the drum motor 121 may be transferred to the heat roller 2.

The main controller 151 receives an arbitrarily changeable web feed amount corresponding to each condition and a timing (condition) at which the web 21 is moved, i.e., an amount by which the web-taking member 23 is rotated. The timing (condition) at which the web 21 is moved is stored in, e.g., a ROM 152, and can be changed, as needed. The web feed amount stored in the ROM 152 can also be changed using, e.g., a control panel 141 connected to the main controller 151.

The main controller 151 compares the length of the web 21 that is stored in the ROM 152 with the count value of a counter 153 which counts the cumulative image forming count. If the main controller 151 estimates that the remaining length of the web 21 becomes shorter than a predetermined length, the main controller 151 can display, e.g., "a message which request replacement of the web 21" on a display 142 of the operation panel 141.

Web feed amount control as a feature of the present invention will be described in detail.

Figures 5, 7:
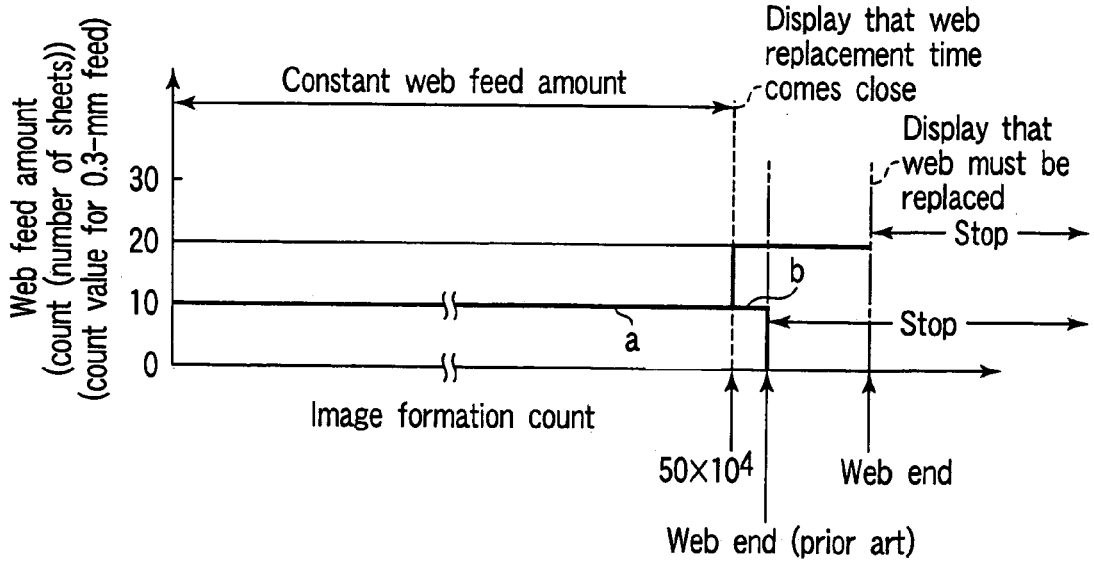
FIG. 5 is a table for explaining an example of control of changing the web feed amount in accordance with the web length and the cumulative image forming count of a copying machine.
FIG. 7 is a graph for explaining application of web feed control shown in FIGS. 5 and 6 in which even if the remaining web runs short, image formation does not stop, and an image having only characters whose image occupation ratio is smaller than a predetermined size can maintain an image quality enough for practical use.

For example, as represented by the curve b in FIG. 7, the web feed amount is almost constant while the number of fed sheets (image forming count) is accumulated in a fixing device having a general web cleaning mechanism. The web is often set to a length by which the web can be used for a period slightly longer than the life (replacement cycle) required for the fixing device. In other words, even if the fixing device normally operates over the life (replacement cycle), the fixing device and web must be replaced (maintained) when the web reaches its end. In this case, image formed (printout) by the image forming apparatus must be stopped until the web or fixing device is replaced.

If the web reaches its end but the fixing device can operate, image formation may continue. However, images printed out on sheets become dirty more and more, as represented by the curve b in FIG. 8. In this case, the degree of wear of the release layer on the surface of the heat roller 2 during image formation increases rapidly when the web reaches its end portion, as represented by the curve b in FIG. 9.

Based on above mentioned, according to the present invention, the web feed amount is changed when the web is detected to come close to its end, from the web length and the cumulative image forming count of the copying machine 101, as shown in FIG. 5.

For example, when the life (replacement cycle) of the fixing device 1 shown in FIG. 2 is a total of 500,000 image forming operations for an image of a predetermined size, the web feed amount is kept at a predetermined amount (in this example, 0.3 mm every 10 image forming operations) up to 500,000 image forming operations, as shown in FIG. 5 (normal control). Note that the web 21 is given a margin of several % at maximum in addition to a length which realizes 500,000 image forming operations.

The image forming count is acquired by referring by the main controller 151 to, e.g., a count value counted by the counter 153. An arbitrary numerical value corresponding to the count value of the discharge counter 114 which counts sheets P discharged onto the discharge tray 113, or the cumulative operation time of the copying machine 101 such as the rotation time of the heat roller or press roller of the fixing device 1 or the cumulative rotation time of the drum motor 121 can be adopted in addition to the image forming count. Although not shown, a taking-up web counter which directly measures the taking-up amount of the web 21 may be arranged in the web motor 125 or web-taking member 23 to directly measure the length of the web 21 used for cleaning. It is also possible to detect the thickness (taking-up diameter) of the web 21 which remains on the web supply member 22 after taking-up and to check the remaining amount of the web 21.

If the cumulative image forming count exceeds 500,000, or the remaining web amount is detected to become small by any of the above-mentioned methods, the web feed amount is changed to 0.3 mm every time image formation is repeated 20 times, as shown in FIG. 5 (deceleration control). At the same time, a message which notifies the user that "the maintenance (web replacement) time of the fixing device comes close." is displayed on the display 142 of the operation panel 141 under the control of the main controller 151. Note that the user may be notified of the maintenance (web replacement) time of the fixing device by any method as far as the method can notify the user of the time. For example, an LED display mechanism may be arranged at an arbitrary position on the control panel 141, and turned on.

According to the embodiment of the present invention, when the web which cleans the surface of the heat roller 2 of the fixing device 1 remains at the end of the life (replacement cycle) of the fixing device 1, an image can be output under a predetermined condition without completely stopping image forming operation of the copying machine 101 until the web of the cleaning mechanism is replenished (replaced) or the fixing device is maintained. This can prevent sudden stop of the copying machine 101 due to a decrease in the remaining amount of the web 21 of the cleaning mechanism. A situation in which the user cannot output any image can be minimized.

If the remaining amount of the web 21 of the cleaning mechanism 6 becomes "0" but image formation continues, the release layer on the surface of the heat roller 2 of the fixing device 1 wears rapidly. To avoid this, image forming operation stops under the control of the main controller 151. At the same time, a message "replace the web of the cleaning mechanism of the fixing device." is displayed on the display 142 of the operation panel 141. In this case, image formation of the copying machine 101 substantially stops. When the message "the maintenance (web replacement) time of the fixing device comes close." is displayed, the user will contact the serviceman. Even if a situation in which the user cannot output any image, the time can be minimized.

Figure 6:
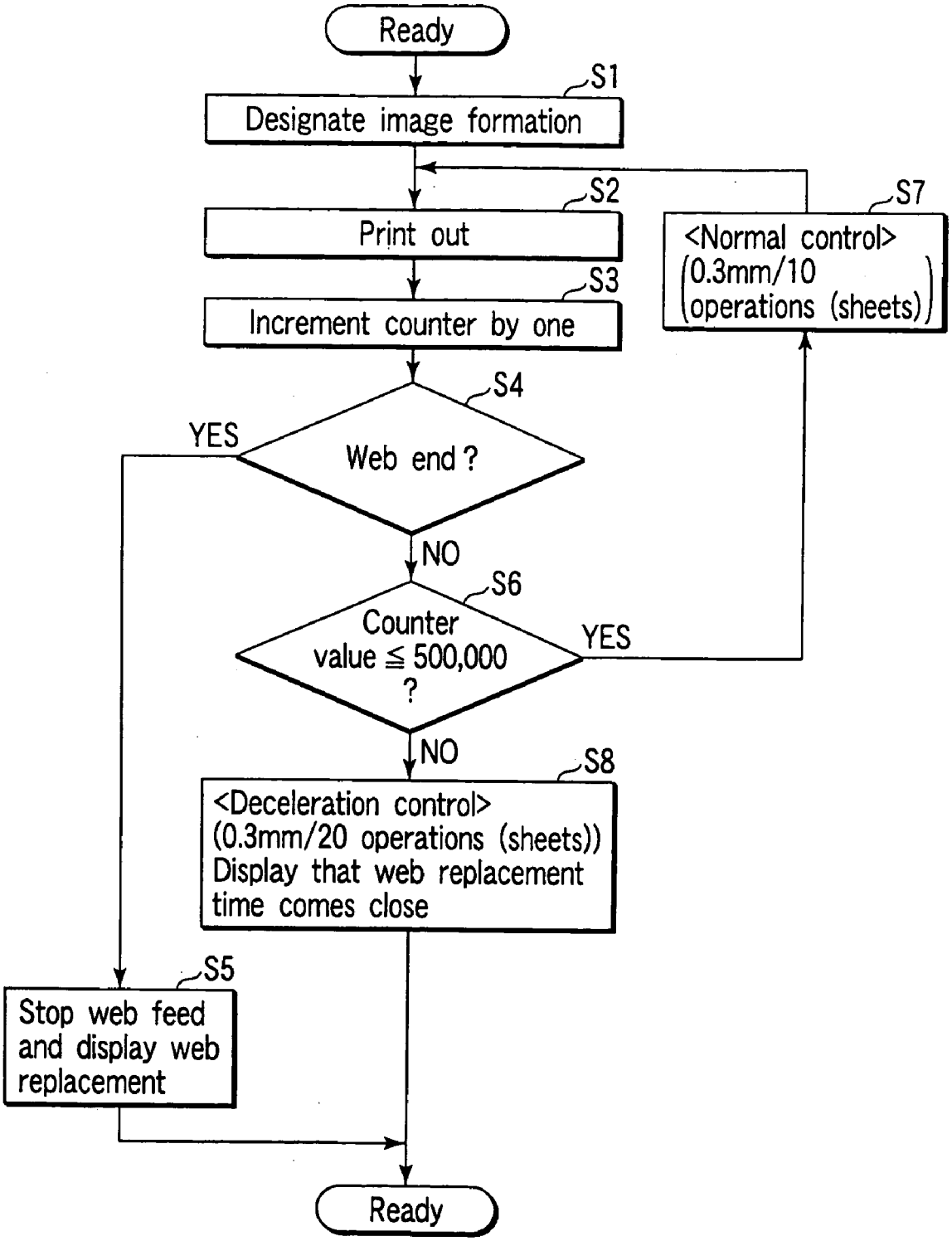
FIG. 6 is a flow chart for explaining web feed control shown in FIG. 5 in more detail.

FIG. 6 is a flow chart for explaining web feed control shown in FIG. 5 in more detail.

As shown in FIG. 6, if image formation is designated while the copying machine 101 is warmed up (S1), an image is output to a sheet in a known image forming step (S2), and the counter 153 is counted up (S3).

Whether the web 21 reaches its end is checked (S4). If the web 21 has already reached its end (YES in S4), the subsequent image formation stops, and the message "replace the web of the cleaning mechanism of the fixing device." is displayed on the display 142 of the operation panel 141 (S5).

If the web 21 is detected in step S4 not to reach the end (NO in S4), whether the cont value of the counter 153 reaches 500,000 is checked (S6).

If the count value is equal to or smaller than 500,000 in step S6 (YES in S6), the web 21 is taken up by the web feed amount (0.3 mm/10 image forming operations) of normal control described above (S7).

If the count value is detected in step S6 to exceed 500,000 (NO in S6), the web 21 is taken up by the web feed amount (0.3 mm/20 image forming operations) of deceleration control described above. In addition, a message "the web of the fixing device comes to the replacement time" is displayed on the display 142 (S8).

As described above, even if it is detected that the replacement time of the web 21 comes close, i.e., the remaining amount of the web 21 becomes small, image formation does not immediately stop. That is, even if deceleration control is executed for the web feed amount when the remaining amount of the web 21 becomes small, an image for which toner is hardly attached to the surface of the heat roller 2 of the fixing device 1 can maintain an image quality enough for practical use. Compared to complete stop of image formation, any disadvantage to the user can be reduced. Note that an image for which toner is hardly attached to the surface of the heat roller 2 is an image having only characters whose image occupation ratio of an image (printout) to a paper having no image is smaller than a predetermined size.

FIG. 7 is a graph showing a comparison between web feed control of the fixing device according to the embodiment of the present invention and the web feed amount in a fixing device with a general web cleaning mechanism.

As represented by the curve b in FIG. 7, the web feed amount in a fixing device having a known web cleaning mechanism is almost constant while the number of fed sheets (image forming count) is accumulated.

According to the embodiment of the present invention, as described with reference to FIGS. 5 and 6, when the web is detected to come close to its end, web feed control is changed from "normal control" to "deceleration control" in which the web feed amount is ½ that of normal control, as represented by the curve a. At the same time, the message which notifies the user that "the maintenance (web replacement) time of the fixing device comes close." is displayed on the display.

Figure 8:
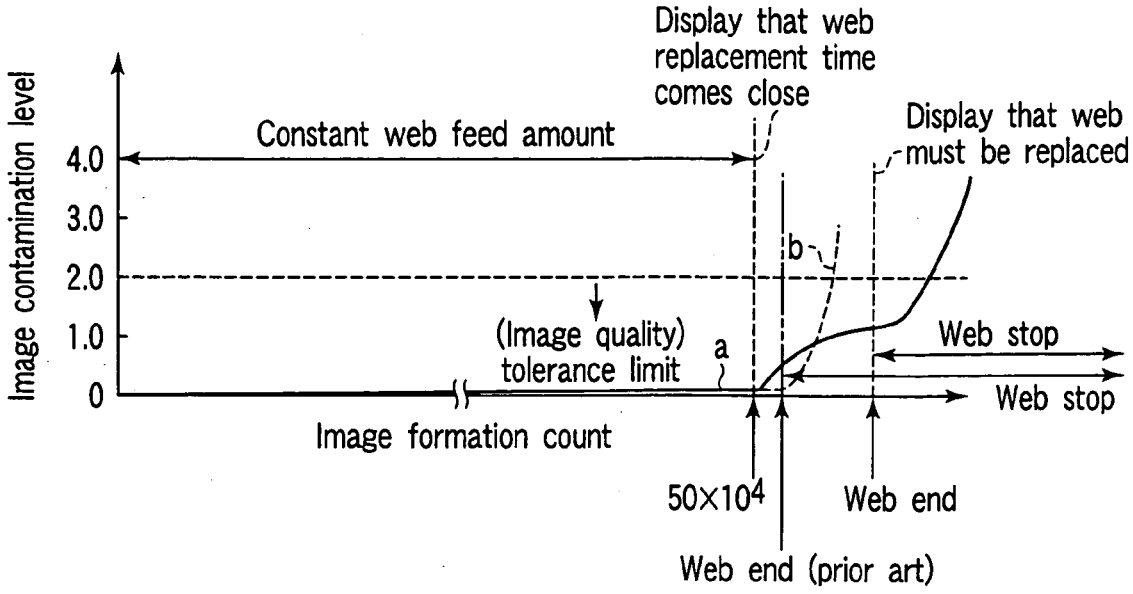
FIG. 8 is a graph for explaining application of web feed control shown in FIGS. 5 and 6 in which even if the remaining web runs short, image formation does not stop, and an image having only characters whose image occupation ratio is smaller than a predetermined size can maintain an image quality enough for practical use.

When web feed control is changed to "deceleration control", the image quality slightly degrades, and particularly the degree of image contamination increases, as represented by the curve a in FIG. 8. However, as described above, degradation can be maintained at a negligible degree in practical use as for an image having only characters whose image occupation ratio is smaller than a predetermined size (example of only known normal control is represented by the curve b for comparison).

Figure 9:
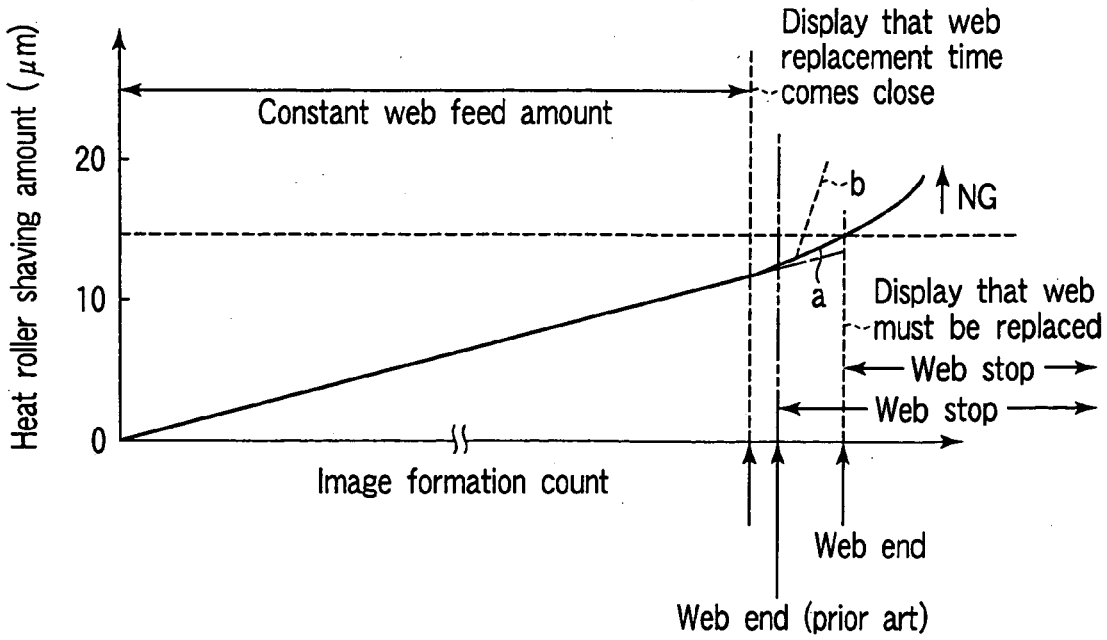
FIG. 9 is a graph for explaining application of web feed control shown in FIGS. 5 and 6 in which even if the remaining web runs short, image formation does not stop, and a release (parting) layer on the surface of a heat roller does not undesirably wear.

If the web reaches its end while the web feed amount is kept constant in known web feed control represented by the curve b, the release layer on the surface of the heat roller 2 rapidly wears, as represented by the curve a in FIG. 9. However, the degree of wear of the surface of the heat roller 2 is suppressed.

In the fixing device having the web cleaning mechanism, when the heat roller is cleaned by the margin of the web length of the web cleaning mechanism with respect to the life of the fixing device main body, the web feed amount is changed to ½ that of normal control, and replacement of the web is prompted. This can prevent a situation in which no image can be formed or the heat roller abruptly wears when the remaining web is used up.

As has been described above, according to the present invention, image formation does not stop even when the remaining web of the cleaning mechanism runs short. An image having only characters whose image occupation ratio is smaller than a predetermined size can maintain an image quality enough for practical use. General maintenance can be done during the maintenance cycle without inhibiting the user from forming any image. Even if the image forming apparatus is kept used over the maintenance cycle, any disadvantage to the user can be substantially suppressed.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fixing device comprising:

means for heating, the heating means is formed into a hollow cylinder or an endless belt, has a outer surface of the cylinder or a belt surface of the belt movable at a predetermined speed, and the heating means can supply predetermined heat to a hot-melt substance and a medium holding the hot-melt substance;

means for applying pressure, the pressure applying means has a outer surface that can move following the outer surface of the cylinder or the belt surface of the belt when the outer surface of the cylinder or the belt surface of the belt of the heating means is moved at the predetermined speed, and the pressure applying means applies a predetermined pressure to the heating means while interposing the hot-melt substance and the medium between the heating means and the pressure application mechanism;

means for exciting the heating means, the exciting means is set to increase a temperature of the heating means, and allows the object to generate heat;

means for taking a hot-melt, the taking means is brought into contact with the outer surface of the cylinder or the belt surface of the belt of the heating means at a predetermined pressure, and the taking means can take the hot-melt substance attached to the outer surface of the cylinder or the belt surface of the belt;

means for changing the taking means, the changing means can move the taking means by a predetermined amount in a region where the taking means is brought into contact with the outer surface of the cylinder or the belt surface of the belt of the heating means at the predetermined pressure when a predetermined amount of the hot-melt substance is absorbed in the taking means;

means for controlling the changing means, the controlling means moves the taking means at a predetermined timing in the region where the taking means is brought into contact with the outer surface of the cylinder or the belt surface of the belt of the heating means; and means for checking an end portion of the taking means, wherein, when the checking means checks that a remaining portion of the taking means reaches a predetermined amount up to the end portion of the taking means, an operation timing of the changing means by the controlling means is delayed at a predetermined ratio.

2. A fixing device according to claim 1, wherein a degree of delaying the operation timing of the changing means by the controlling means changes the taking means is a ratio capable of setting a feed amount of the taking means that hardly generates image degradation only when continuing formation of an image whose ratio of output image information to a medium to be transferred is smaller than a predetermined ratio.

3. A fixing device according to claim 1, wherein a degree of delaying the operation timing of the changing means by the controlling means changes the taking means is a ratio capable of setting a feed amount of the taking means by which a degree of wear of a surface of the heating means can be so maintained as to hardly generate image degradation.

4. An image forming apparatus comprising:

means for displaying an operation state of the apparatus and a predetermined message;

means for holding an electrostatic image, wherein the holding means is photosensitive;

means for developing, the developing means supplies toner to the electrostatic image formed on the holding means and visualizes the electrostatic image;

means for transferring to a medium to be transferred, a toner image formed by supplying the toner from the developing means to the electrostatic image formed on the holding means; and means for fixing includes a heating member capable of supplying predetermined heat to the toner serving as the toner image on the medium to be transferred, a temperature increasing mechanism that increases temperatures of the heating member and a press member capable of applying a predetermined pressure to the heat member in order to fix the toner melted by heat from the heating member to the medium to be transferred, and a web cleaning mechanism that removes toner attached to a surface of the heating member, the fixing means applies heat and a pressure to the toner image transferred to the medium to be transferred, thereby fixing the toner image to the medium to be transferred, wherein the web cleaning mechanism includes a web which is brought into contact with the surface of the heating member, a web-taking mechanism which moves a web to which a predetermined amount of toner is attached upon contact with the surface of the heating member for a predetermined time, a remaining web amount checking mechanism which checks a remaining web amount, and a web-taking mechanism driver which operates the web-taking mechanism at a predetermined timing, and when the remaining web amount checking mechanism checks that the remaining web amount becomes not more than a predetermined amount, the displaying means is instructed to display the predetermined message, and when the remaining web amount checking mechanism checks that the remaining web amount becomes not more than the predetermined amount, a timing at which the web-taking mechanism is operated by the web-taking mechanism driver can be reduced at a predetermined ratio.

5. An image forming apparatus according to claim 4, wherein the timing at which the web-taking mechanism is operated by the web-taking mechanism driver allows setting a web feed amount which hardly generates image degradation only when formation of an image whose ratio of output image information to a medium to be transferred is smaller than a predetermined ratio continues after the remaining web amount becomes small.

6. A cleaning method comprising:

bringing a web in contact with a surface of a heating member;

removing toner from the web using a web cleaning mechanism;

checking remaining amount of the web;

displaying a predetermined message when the checked web remaining amount is not more than a first remaining amount; and reducing the number of times the web cleaning mechanism is operated, at a predetermined rate, when the checked web remaining amount is not more than a second remaining amount.

7. A cleaning method according to claim 6, wherein the web cleaning mechanism is operated at a web feed rate that prevents image defects in the case where the checked web remaining amount is not more than the second remaining amount, and only when an image forming operation is continued, the image forming operation being an operation for forming an image containing an output image information amount less than a predetermined amount.

8. A cleaning method according to claim 6, wherein when the checked web remaining amount reaches a predetermined amount, a notification is output indicating that the web should be replaced.

9. A cleaning method according to claim 6, wherein when the checked web remaining amount reaches zero, a web feeding operation is stopped, and a notification is output indicating that the web must be replaced.

* * * * *